US011164706B2

(12) United States Patent
Wozniak et al.

(10) Patent No.: US 11,164,706 B2
(45) Date of Patent: Nov. 2, 2021

(54) ELASTOMERIC KEYPAD

(71) Applicant: MERIT AUTOMOTIVE ELECTRONICS SYSTEMS S.L.U., Barcelona (ES)

(72) Inventors: Marek Wozniak, Mogilany (PL); Przemyslaw Madon, Cracow (PL)

(73) Assignee: Merit Automotive Electronics Systems S.L.U.

( * ) Notice: Subject to any disclaimer, the term of this patent is extended or adjusted under 35 U.S.C. 154(b) by 0 days.

(21) Appl. No.: 16/650,897

(22) PCT Filed: Sep. 26, 2017

(86) PCT No.: PCT/PL2017/000095
§ 371 (c)(1),
(2) Date: Mar. 26, 2020

(87) PCT Pub. No.: WO2019/066667
PCT Pub. Date: Apr. 4, 2019

(65) Prior Publication Data
US 2020/0286698 A1 Sep. 10, 2020

(51) Int. Cl.
*H01H 13/82* (2006.01)

(52) U.S. Cl.
CPC ..... *H01H 13/82* (2013.01); *H01H 2213/008* (2013.01)

(58) Field of Classification Search
CPC .. H01H 13/82; H01H 2213/008; H01H 13/06; H01H 13/14; H01H 2213/014;
(Continued)

(56) References Cited

U.S. PATENT DOCUMENTS 1,329,559 A 2/1920 Tesla
4,527,030 A 7/1985 Delsch
(Continued)

FOREIGN PATENT DOCUMENTS

DE 10 2009 051 829 A1 5/2011
SU 955248 A1 8/1982

OTHER PUBLICATIONS

International Search Report, PCT/PL2017/000095, dated Jun. 14, 2018, 3 pages.
(Continued)

*Primary Examiner* — Lheiren Mae A Caroc
(74) *Attorney, Agent, or Firm* — Ware, Fressola, Maguire & Barber LLP

(57) ABSTRACT

An elastomeric keypad (1) is shown having at least one key (3) having an elastomeric dome (41) defining a chamber (42) and provided inside with an activating means (43), an activation means (44) cooperating with the activating means (43), and at least one compensating channel (48) opening at the chamber (42) to enable for a flow of fluid from the chamber (42), while the elastomeric dome (41) collapses, and to the chamber (42), while the elastomeric dome (41) releases. In order to suppress the sound intensity of the push up event, at least one of the compensating channels (48) includes at least one valve arrangement (5) generating fluid restrictions while the fluid returns to the chamber (42). Preferably the valve arrangement (5) has a form of a Tesla Valve.

12 Claims, 2 Drawing Sheets

(58) Field of Classification Search
CPC ..... H01H 2213/006; H01H 2205/002; H01H 2205/004; H01H 2213/00; H01H 2213/002; H01H 2213/01; H01H 2215/048; H01H 2223/004; H01H 2227/02; H01H 9/047; H01H 2213/004; H01H 13/84; H01H 2215/03; H01H 2221/036; H01H 2221/038; G06F 3/0202
USPC ..... 200/306
See application file for complete search history.

(56) References Cited

U.S. PATENT DOCUMENTS

| | | | | |
|---|---|---|---|---|
| 5,418,530 | A | 5/1995 | Moore et al. | |
| 5,672,781 | A | 9/1997 | Koehler et al. | |
| 5,710,397 | A | 1/1998 | Liao | |
| 5,874,700 | A | 2/1999 | Hochgesang | |
| 7,557,312 | B2 * | 7/2009 | Clark | G06F 3/0202 200/5 A |
| 9,741,507 | B2 * | 8/2017 | Nishino | H01H 13/7073 |
| 10,109,436 | B2 * | 10/2018 | Wang | H01H 13/82 |
| 10,176,942 | B2 * | 1/2019 | Han | H01H 13/705 |
| 10,312,033 | B2 * | 6/2019 | Han | G06F 1/1666 |
| 2002/0000932 | A1 | 1/2002 | Shih et al. | |
| 2002/0163451 | A1 | 11/2002 | Johnston et al. | |
| 2005/0000789 | A1 | 1/2005 | Yoneyama | |
| 2009/0032380 | A1 | 2/2009 | Yeh et al. | |
| 2012/0160655 | A1 * | 6/2012 | Takai | H01H 13/82 200/513 |

OTHER PUBLICATIONS

Written Opinion of the International Search Authority, PCT/PL2017/000095, dated Jun. 14, 2018, 6 pages.

* cited by examiner

ELASTOMERIC KEYPAD

BACKGROUND OF THE INVENTION

1. Technical Field

The present invention relates to an elastomeric keypad having at least one key comprising an elastomeric dome defining a chamber and provided inside with an activating means, an activation means cooperating with said activating means to transmit the signal indicating said key activation to an external control system, and at least one compensating channel opening at said chamber to enable for a flow of fluid from said chamber, while said elastomeric dome collapses, and to said chamber, while said elastomeric dome releases.

2. Discussion of Related Art

Elastomeric keypads of this kind, also known as silicone rubber keypads, are used as a low cost and reliable switching solution.

Patent application US 2002163451 discloses a liquid proof switch array comprising an array of elastomeric domes, each defining a chamber, and a plurality of channels interconnecting the chambers of the domes such that each chamber of each dome is in fluid communication with the chamber of at least one of the other domes enabling for an unrestricted flow of air between these chambers.

Other keypad constructions comprising elastomeric domes defining chambers interconnected by channels are also known from publications U.S. Pat. No. 4,527,030, US 2005000789, US 2002009322, US 2009032380 or U.S. Pat. No. 5,874,700.

A sound is generated while a dome is depressed inside and another sound is generated while the dome returns back to its neutral position. The sonority of the keypad is therefore characterized by two events: push down event and push up event. As the action of the key is triggered while the key is pushed down, the sound intensity of the push down event should be obviously higher than that of the push up event. Unfortunately, known elastomeric keypads feature quite opposite characteristic: the sound intensity of the push down event is lower, because it is suppressed by the dome deformation, while the sound intensity of the push up event is not only not suppressed, but usually also generated during collision of the dome with a plastic button or a key cap that in turn collides with the keypad housing.

Publication U.S. Pat. No. 5,710,397 discloses a switch actuator comprising a rubber dome, a housing and a keytop with a plunger. The rubber dome is seated on the switch and is selectively deformed to actuate the switch. The housing receives the rubber dome therein and has an upper opening defining an edge of the opening and has an inner surface. The plunger moves reciprocally within the housing and is guided by the edge during the reciprocal movement of the keytop. The keytop, which has a bottom surface, moves reciprocally and vertically together with the plunger to selectively deform the rubber dome to actuate the switch as the result of the operation of the user. In order to improve the keypad sound characteristic, a slant surface is formed on the inner surface of the housing to retain the bifurcated hook end of the plunger in order to reduce the noise generated during return movement of the plunger.

Other keypad constructions improving the keypad sound characteristic are known e.g. from publication U.S. Pat. No. 5,418,530 disclosing a key with silent return movement or U.S. Pat. No. 6,672,781 disclosing a reduced noise key unit.

Publication DE 10 2009 051829 A1 discloses an electric switch having two opposite contact surfaces separated in an opened state of the switch by spaces filled with an insulating fluid. A fluid reservoir is fluidically connected with the spaces for delivering the insulating fluid in case of displacement of the fluid reservoir by mechanical pressure on the fluid reservoir at the spaces such that the switch is changed from a closed state into the opened state. The connection between the reservoir and the space acts as a kind of fluid brake.

Therefore it has been the object of the present invention to provide an elastomeric keypad in which the sound intensity of the push down event would be higher than that of the push up event, which would be cost efficient and simple to manufacture.

SUMMARY OF THE INVENTION

A keypad of the of the kind mentioned in the outset, according to the present invention is characterized in that at least one of said compensating channels comprises at least one valve arrangement acting as a passive check valve generating fluid restrictions while the fluid returns to said chamber, while providing substantially laminar flow of fluid while said elastomeric dome collapses.

Preferably said valve arrangement has a form of a Tesla Valve.

Preferably said valve arrangement extends along the entire length of said compensating channel.

Preferably said compensating channel is terminated with a compensating chamber.

Preferably the keypad according to the present invention comprises a plurality of said domes, formed integrally in an elastomeric sheet.

Preferably said compensating channels and said passive check valves are formed within said elastomeric sheet.

Preferably said elastomeric sheet adjoins a support plate.

Preferably said at least one key comprises a key cap disposed slidably within a housing and said elastomeric dome cooperates with said key cap.

Preferably said activating means and/or said activation means has/have a form of a conductive layer(s).

Preferably said at least one key comprises a spring disposed inside said elastomeric dome.

BRIEF DESCRIPTION OF DRAWINGS

The invention shall be described and explained below in connection with the attached drawings on which.

DETAILED DESCRIPTION OF EMBODIMENTS

Figure 1:
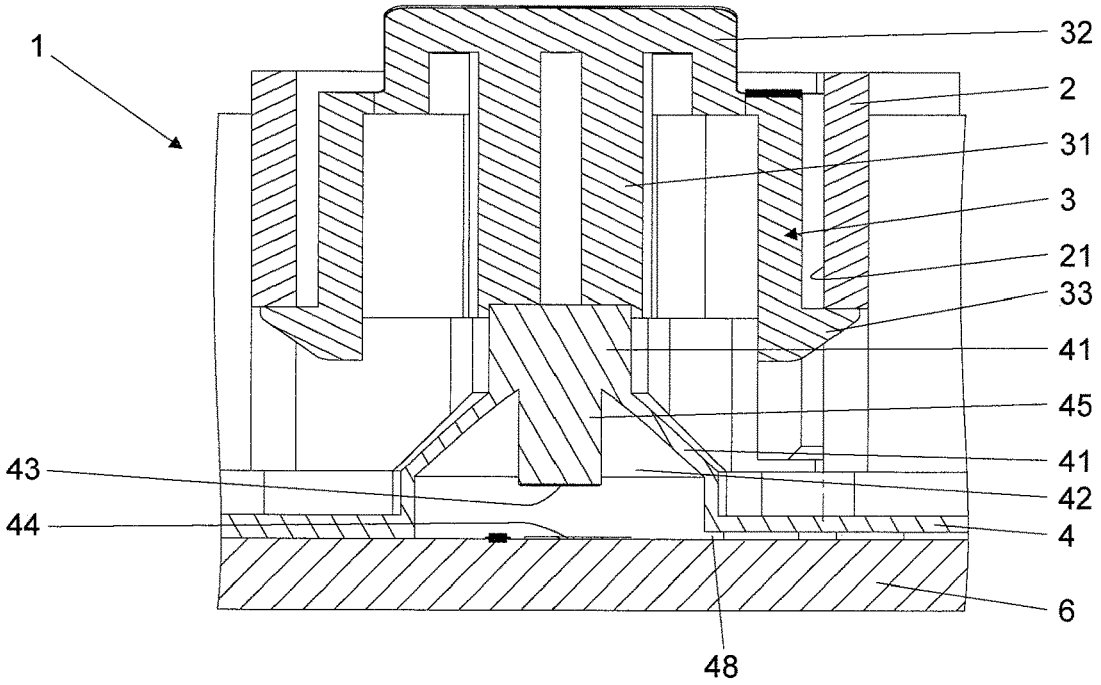
FIG. 1 is a schematic cross-sectional view of a part of an embodiment of a keypad according to the present invention.

FIG. 1 presents an embodiment of a keypad 1 according to the present invention comprising a housing 2 having seven keys 3. Each key 3 comprises a key cap 32 having a plunger 31 disposed slidably within an opening 21 of the housing 2. An elastomeric sheet 4 is disposed inside the housing 2 and comprises seven domes 41 disposed beneath the plungers 31 of the keys 3. Each dome 41 defines a chamber 42 and is provided inside with an activating means 43, in a form of a conductive layer, cooperating with an activation means 44, also in a form of a conductive layer, disposed beneath the elastomeric sheet 4 at a rigid support plate 6 of the keypad. Each dome 41 normally maintains an inactive position of the key 3 acting on a plunger 31 and keeping the key cap 32 in its upward position with respect to the drawing. To this end a limiter 33 in a form of a circumferential recess is snap-locked over the edge of the opening 21 preventing the key cap 32 from sliding out.

As it is known from the state of art, when user presses the key cap 32 with a finger, the plunger 31 moves downward acting on the dome 41, the dome 41 collapses and eventually the activating conductive layer 43 inside the dome 41 touches the activation conductive layer 44 having two or more separate electrical paths (not shown) creating a conducting path between them and transmitting the signal indicating a given key activation to an external control system (not shown), the keypad 1 is coupled with. Moving and interacting elements of the key 3, as well as the deforming dome 41 generate a sound during such a push down event. When user releases the key cap 32, strain energy stored in the dome 41 during its deformation is also rapidly released forcing the dome 41 to rapidly return to its neutral position along with the key cap 32. Another sound is generated during such a push up event which is usually louder than the sound of the push down event, as the dome 41 collides with the plunger 31 of the key cap 32, which in turn collides with the keypad housing 2.

To enable for a flow of air from the chamber 42, while the elastomeric dome 41 is pushed down, and back to the chamber 42, while the elastomeric dome 41 is pushed up, the chamber 42 is fluidly connected with a compensating channel 48. The compensating channels 48 are terminated with compensating chambers 47 or led outside via openings 47*a*.

Figure 2:
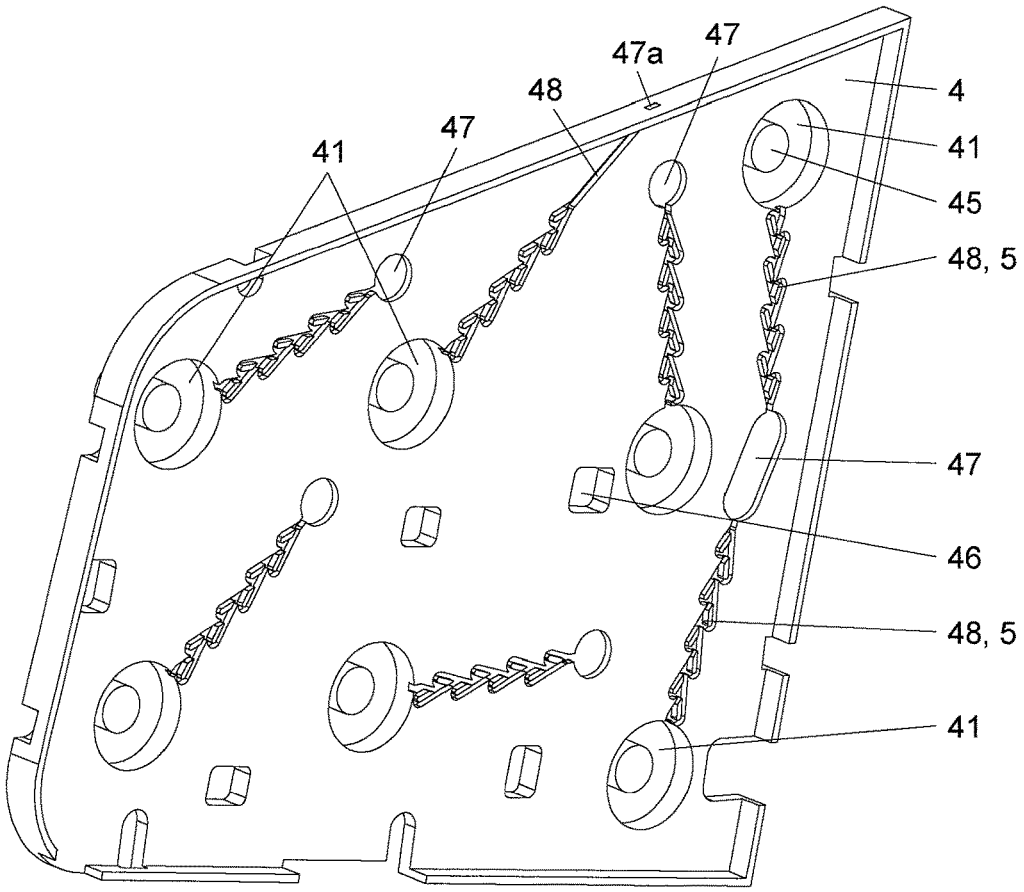
FIG. 2 is a perspective view of an elastomeric sheet of the keypad shown in FIG. 1.
Figure 3A:
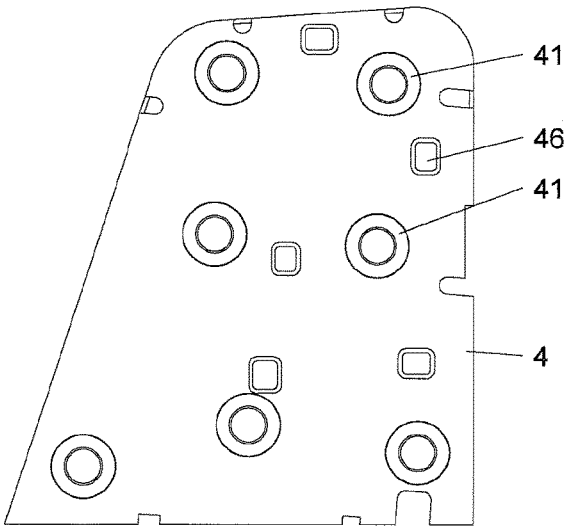
FIG. 3*a* illustrates a top view of the elastomeric sheet shown in FIG. 2.
Figure 3B:
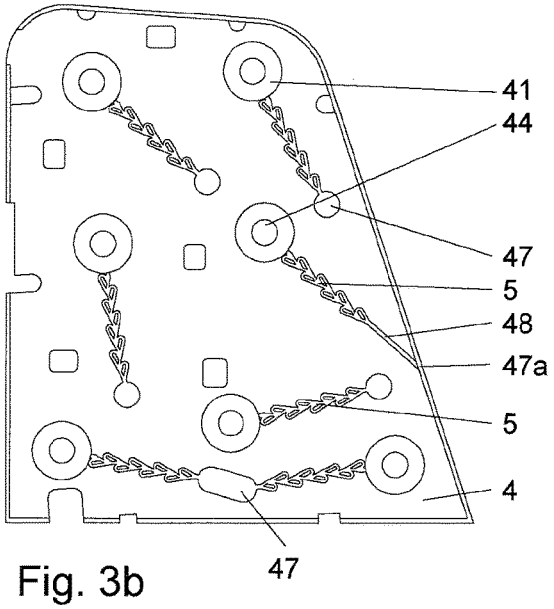
FIG. 3*b* illustrates a bottom view of the elastomeric sheet shown in FIG. 2.
Figure 3C:
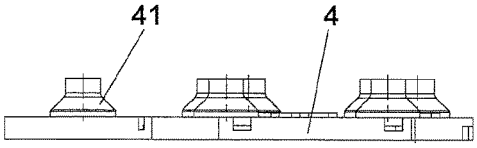
FIG. 3*c* illustrates a side view of the elastomeric sheet shown in FIG. 2.

As shown in FIG. 2 and FIG. 3*b* each compensating channel 48 comprises a valve arrangement 5 in a form of a Tesla Valve extending almost along the entire length of the channel 48.

Figure 4A:
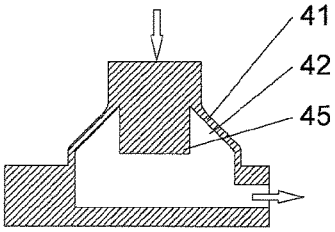
FIG. 4*a* illustrates the operation of an embodiment of the keypad while the key is pressed in a cross-sectional view.
Figure 4B:
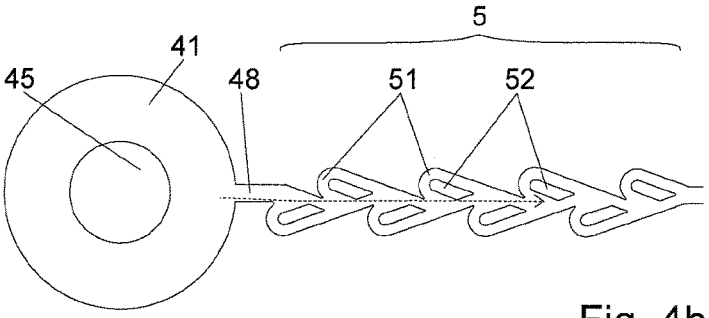
FIG. 4*b* illustrates the operation of the embodiment of the keypad of FIG. 4*a* while the key is pressed in a bottom view.
Figure 5A:
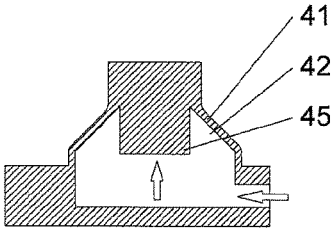
FIG. 5*a* illustrates the operation of the embodiment of the keypad of FIG. 4*a* while the key returns to its normal position in a cross-sectional view.
Figure 5B:
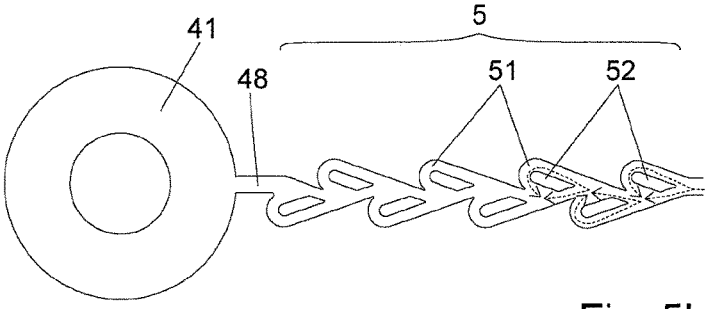
FIG. 5*b* illustrates the operation of the embodiment of the keypad of FIG. 5*a* while the key returns to its normal position in a bottom view.

The interior of each Tesla Valve 5 is provided with meanders 51 and baffles 52 which, while offering virtually no resistance to the flow of air from the chamber 42 to the compensating chamber 47 (cf. FIGS. 4*a* and 4*b*), other than surface friction, constitute an almost impassable barrier to its flow in the opposite direction (cf. FIGS. 5*a* and 5*b*).

In other words, as shown with dashed arrows in FIG. 4*b* and FIG. 5*b*, the valve arrangement 5 act as a passive check valve providing substantially laminar flow of air during a push down event, and substantially turbulent flow during a push up event. This in turn requires more time for the dome chamber 42 to be filed by returning air and therefore supresses strain energy release of the dome 41. Therefore the dome 41 releases or returns slowly to its neutral position not hitting the plunger 31. Consequently the sound intensity of the push up event is suppressed.

Though in the presented embodiment the valve arrangement 5 extends along the entire length of the compensating channel 48 it is obviously not necessary. The dome 41 may also be connected with more than one compensating channel 48.

The above embodiments of the present invention are merely exemplary. The figures are not necessarily to scale, and some features may be exaggerated or minimized. These and other factors however should not be considered as limiting the spirit of the invention, the intended scope of protection of which is indicated in appended claims.

LIST OF REFERENCE NUMERALS

1. keypad
2. housing
  21. opening
3. key
  31. plunger
  32. key cap
  33. limiter
4. elastomeric sheet
  41. dome
  42. chamber
  43. activating means (conductive layer)
  44. activation means (conductive layer)
  45. plunger
  46. fixing hole
  47. compensating chamber (opening)
  48. compensating channel
5. valve
  51. meander
  52. baffle
6. support plate

The invention claimed is:

1. An elastomeric keypad (1) having at least one key (3) comprising an elastomeric dome (41) defining a chamber (42) and provided inside with an activating means (43), an activation means (44) cooperating with said activating means (43) to transmit a signal indicating said key (3) activation to an external control system, and at least one compensating channel (48) opening at said chamber (42) to enable for a flow of fluid from said chamber (42), while said elastomeric dome (41) collapses, and to said chamber (42), while said elastomeric dome (41) releases, characterized in that at least one of said compensating channels (48) comprises at least one valve arrangement (5) acting as a passive check valve generating fluid restrictions with substantially turbulent flow while the fluid returns to said chamber (42), while providing substantially laminar flow of fluid while said elastomeric dome (41) collapses.

2. The keypad according to claim 1, characterized in that, said passive check valve (5) has a form of a Tesla Valve.

3. The keypad according to claim 1, characterized in that, said passive check valve (5) extends along the entire length of said compensating channel (48).

4. The keypad according to claim 1, characterized in that, said compensating channel (48) is terminated with a compensating chamber (47).

5. The keypad according to claim 1, characterized in that, said keypad comprises a plurality of keys (3) and corresponding plurality of domes (41) formed integrally in an elastomeric sheet (4).

6. The keypad according to claim 5, characterized in that, for each key (3) of said plurality of keys there is formed within the elastomeric sheet (4) a compensating channel (48) and a passive check valve (5).

7. The keypad according to claim 5, characterized in that, said elastomeric sheet (4) adjoins a support plate (6).

8. The keypad according to claim 1, characterized in that, said at least one key (3) comprises a key cap (32) disposed slidably within a housing (2) and said elastomeric dome (41) cooperates with said key cap (32).

9. The keypad according to claim 1, characterized in that, said activating means (43) and/or said activation means (44) has/have a form of a conductive layer(s).

10. An elastomeric keypad (1) having at least one key (3) comprising an elastomeric dome (41) defining a chamber (42) and provided inside with an activating means (43), an activation means (44) cooperating with said activating means (43) to transmit a signal indicating said key (3) activation to an external control system, and at least one compensating channel (48) opening at said chamber (42) to enable for a flow of fluid from said chamber (42), while said elastomeric dome (41) collapses, and to said chamber (42), while said elastomeric dome (41) releases, characterized in that at least one of said compensating channels (48) comprises at least one valve arrangement (5) acting as a passive check valve generating fluid restrictions while the fluid returns to said chamber (42), while providing substantially laminar flow of fluid while said elastomeric dome (41) collapses, further characterized in that said passive check valve (5) has a form of a Tesla Valve.

11. An elastomeric keypad (1) having at least one key (3) comprising an elastomeric dome (41) defining a chamber (42) and provided inside with an activating means (43), an activation means (44) cooperating with said activating means (43) to transmit a signal indicating said key (3) activation to an external control system, and at least one compensating channel (48) opening at said chamber (42) to enable for a flow of fluid from said chamber (42), while said elastomeric dome (41) collapses, and to said chamber (42), while said elastomeric dome (41) releases, characterized in that at least one of said compensating channels (48) comprises at least one valve arrangement (5) acting as a passive check valve generating fluid restrictions while the fluid returns to said chamber (42), while providing substantially laminar flow of fluid while said elastomeric dome (41) collapses, further characterized in that said passive check valve (5) extends along the entire length of said compensating channel (48).

12. An elastomeric keypad (1) having at least one key (3) comprising an elastomeric dome (41) defining a chamber (42) and provided inside with an activating means (43), an activation means (44) cooperating with said activating means (43) to transmit a signal indicating said key (3) activation to an external control system, and at least one compensating channel (48) opening at said chamber (42) to enable for a flow of fluid from said chamber (42), while said elastomeric dome (41) collapses, and to said chamber (42), while said elastomeric dome (41) releases, characterized in that at least one of said compensating channels (48) comprises at least one valve arrangement (5) acting as a passive check valve generating fluid restrictions while the fluid returns to said chamber (42), while providing substantially laminar flow of fluid while said elastomeric dome (41) collapses, further characterized in that said keypad comprises a plurality of keys (3) and corresponding plurality of domes (41) formed integrally in an elastomeric sheet (4) and in that for each key (3) of said plurality of keys there is formed within the elastomeric sheet (4) a compensating channel (48) and a passive check valve (5).

* * * * *